US005805115A

United States Patent [19]

Pellerin et al.

[11] Patent Number: 5,805,115

[45] Date of Patent: Sep. 8, 1998

[54] ROTARY MICROWAVE ANTENNA SYSTEM

[75] Inventors: Andrew Pellerin, Salem, N.H.; David Faulkner, Middleton, Mass.; Brian McLaughlin, Windham, N.H.; Ernie Lattanzi, Sarasota, Fla.

[73] Assignee: Kevlin Corporation, Wilmington, Mass.

[21] Appl. No.: 509,799

[22] Filed: Aug. 1, 1995

[51] Int. Cl.[6] ..... H01Q 3/02; H01P 1/06

[52] U.S. Cl. ..... 343/763; 333/261

[58] Field of Search ..... 333/256, 257, 333/261; 343/763

[56] References Cited

U.S. PATENT DOCUMENTS

| | | | |
|---|---|---|---|
| 1,070,307 | 8/1913 | Twining . | |
| 1,199,172 | 9/1916 | Garrison . | |
| 1,665,018 | 4/1928 | Black . | |
| 2,064,585 | 12/1936 | Atienza . | |
| 2,181,145 | 11/1939 | Mose . | |
| 2,412,867 | 12/1946 | Briggs et al. . | |
| 2,422,961 | 6/1947 | Hallstrand . | |
| 2,434,509 | 1/1948 | Okress . | |
| 2,451,876 | 10/1948 | Salisbury . | |
| 2,476,732 | 7/1949 | Hollingsworth et al. . | |
| 2,479,897 | 8/1949 | Baxter et al. . | |
| 2,541,836 | 2/1951 | Salisbury . | |
| 2,602,895 | 7/1952 | Hansen | 333/256 X |
| 2,627,551 | 2/1953 | Taylor et al. . | |
| 2,633,493 | 3/1953 | Cohn . | |
| 2,918,638 | 12/1959 | Cattoi et al. . | |
| 3,011,137 | 11/1961 | Albanese et al. | 333/256 |
| 3,143,717 | 8/1964 | Gordon | 333/261 |
| 3,146,411 | 8/1964 | Filipezak | 333/261 X |
| 3,223,949 | 12/1965 | Lapham | 333/261 X |
| 4,020,431 | 4/1977 | Saunders | 333/256 |
| 4,298,850 | 11/1981 | Pellerin et al. | 333/257 |
| 4,786,136 | 11/1988 | Cannon . | |
| 4,908,630 | 3/1990 | Clerc | 343/763 |
| 5,018,174 | 5/1991 | Collins | 378/4 |

*Primary Examiner*—Benny T. Lee
*Attorney, Agent, or Firm*—Richard B. Smith

[57] ABSTRACT

A rotary microwave antenna system suitable for satellite or cellular microwave radio telecommunications features an integrated, low-profile, rotary microwave joint, slip ring and antenna assembly. The rotary antenna system includes a stator (i.e., stationary portion), for attachment to a mobile platform (e.g., an automobile or other vehicle), having a rotary joint coaxial microwave coupler for electrically coupling a microwave transmission line from a microwave telecommunications radio system to a microwave antenna element of an microwave antenna rotatable about an axis relative to the mobile platform. The rotary antenna system also includes a rotor (i.e., rotary portion) for attachment to the microwave antenna. The rotor includes a slip ring circuit (or brushes) for coupling power and low frequency electrical signals to the microwave antenna through contacting brushes (or slip ring) attached to the stator, rotates relative to the stator, and is concentric with the axis of rotation of the microwave antenna. The stator includes a disk having a peripheral edge around its circumference, and the rotor includes an annular ring having an inner edge around a central opening and a peripheral edge around its circumference. The inner edge of the rotor is adjacent to, concentric with, and rotatably coupled to the peripheral edge of the central disk by means of an assembly of ball bearings placed between the two adjacent edges.

16 Claims, 7 Drawing Sheets

ROTARY MICROWAVE ANTENNA SYSTEM

FIELD OF THE INVENTION

This invention is directed to an apparatus for coupling microwave frequency energy, DC power and low frequency signals through a mechanically rotatable joint to a microwave antenna system.

BACKGROUND OF THE INVENTION

The use of rotary joints for conducting microwave energy to a rotatable antenna system is a relatively old problem that has been solved in a variety of ways. Solutions for coupling microwave energy have included contact and non-contact coaxial single channel couplers, as well as multi-channel couplers. A widely used rotary joint structure for conducting microwave energy from one transmission line to another, or from a transmission line to an antenna, is a coaxial transmission line divided into two sections that match each other mechanically and electrically where they meet so that one section can rotate on their common axis with respect to the other section. Furthermore, coaxial rotary joints have been described with cable connector systems on both sections, or with other types of transmission line couplers, and require transmission line input to and output from the rotary joint.

Slip ring couplers have been used for conducting DC power and low frequency signals to and from the components of a rotatable antenna system. One widely used slip ring structure uses several concentric conductive channels laid upon a disk-like substrate mounted to the rotatable antenna system and centered about an axis of rotation. Conductive brushes mounted to the stationary platform slidably and resiliently contact the conductive channels to electrically connect the subsystems during rotation. In other slip ring couplers, the conductive channels are attached to the stationary platform, and the conductive brushes are attached to, and rotate with the antenna system.

The rotary joints and slip rings described in the prior art, while often used in conjunction with one another, are distinct devices, each having its own bearings, mountings and cable connectors. Often such devices contain multiple bearings and cable connectors. Rotary joints and slip ring devices, when combined, are useful for rotary antenna systems, but result in large, heavy, complex and expensive rotary joint and slip ring systems. Therefore, the resulting rotary antenna system is necessarily large, heavy, complex and expensive. Typically, each component is supplied by a different manufacturer, and is bolted together by the system manufacturer. The integration of these components into an integral package has not heretofore been accomplished.

Satellite telecommunications systems allow microwave radiotelephones to directly access an earth orbital satellite for communications even from the most remote location. One disadvantage of these satellite systems is that the microwave radiotelephone antenna must be carefully aimed at the satellite and remain so during the duration of the communications. Such a requirement has essentially precluded the use of such satellite radiotelephones aboard a moving vehicle. The same applies for remote cellular telephone systems that require cell site tracking. Automatic satellite and cell tracking systems may be developed for aiming the radiotelephone antenna at the satellite or cell while the vehicle is in motion. One important component of such a system is the rotary microwave antenna system necessary to track the satellite or cell site while the vehicle is in motion, including high speed travel. Historically, cost, reliability, size and weight have been important factors in all mobile telecommunications systems. Rotary microwave antenna systems have heretofore been large, heavy, complex and expensive. Therefore, it is desirable to have a simple, inexpensive, small and light weight rotary microwave antenna system for use with such mobile satellite and cellular telecommunications systems. Other microwave systems that require antenna tracking can also benefit from such a rotary antenna system.

SUMMARY OF THE INVENTION

In accordance with the present invention, a rotary microwave antenna system suitable for satellite or cellular microwave radio telecommunications features an integrated, low-profile, rotary microwave joint, slip ring, drive mechanism and antenna assembly. This invention provides an integrated low profile, economical microwave antenna coupler and antenna platform for a rotatable microwave antenna system about one-quarter the size and weight of previous systems manufactured from discrete components. The invention features, among other things, a single bearing integrated rotary joint, slip ring and antenna platform featuring high performance and reliability, low cost, light weight and small size and low profile.

In general, one aspect the invention features a structurally integrated rotary microwave antenna system for transmitting and receiving microwave signals. The rotary antenna system includes a stator (i.e., stationary portion) for attachment to a mobile platform (e.g., an automobile, train or other vehicle), having a rotary joint coaxial microwave coupler for electrically coupling a microwave transmission line from a microwave telecommunications radio system to a microwave antenna element of a microwave antenna system rotatable about an axis relative to the mobile platform. The rotary antenna system also includes a slip ring rotor (i.e., rotary portion) for attachment to the microwave antenna by means of a single bearing structure. The rotor includes a slip ring circuit for coupling DC power and low frequency electrical signals to the microwave antenna. The slip ring circuit has an annular disk with a plurality of concentric electrical conducting channels electrically connected to the electronics of the antenna. The channels movably contact a plurality of electrical conducting brushes mounted to the stator carrying power and signals from the microwave telecommunications radio system to the electronics of the antenna. The rotor is rotatably coupled to the stator so that the rotor rotates relative to the stator and concentric with the axis of rotation of the microwave antenna. In some embodiments, the microwave antenna includes an r.f. microwave antenna, and the rotor includes an antenna pedestal for mounting the microwave antenna to the rotor on the side of the rotor opposite to the slip ring.

In preferred embodiments the rotary joint coaxial microwave coupler includes a center conductor rotatable about the axis of rotation of the microwave antenna. The center conductor is mechanically and electrically connected (capacitively coupled) to the microwave antenna on one end, and is terminated on the other end in a microwave transmission line connector. The transmission line connector can be connected to the microwave radio telecommunication system.

In yet other preferred embodiments, the stator includes a disk having a peripheral edge around its circumference, and the rotor includes an annular ring having an inner edge around a central opening and a peripheral edge around its circumference. The inner edge of the rotor is positioned adjacent to, concentric with, and is rotatably coupled to the peripheral edge of the stator disk by means of a single assembly of ball bearings placed between the two adjacent edges. In some embodiments, the peripheral edge of the rotor includes a surface for coupling to a drive motor for rotating the rotor relative to the stator. Embodiments include gear teeth, belt drive or a friction surface for coupling to a drive motor. The stator disk and the rotor annular ring are substantially the same thickness.

In general, in another aspect the invention features a structurally integrated rotary microwave antenna system including a stator, for attachment to a mobile platform, having a rotary joint coaxial microwave coupler for electrically coupling a microwave transmission line from a microwave telecommunications radio system to a microwave antenna element of an microwave antenna rotatable about an axis relative to the mobile platform, and a slip ring circuit for coupling DC power and low frequency electrical signals to the microwave antenna. The slip ring circuit has an annular disk with a plurality of concentric electrical conducting channels electrically connected to the microwave telecommunications radio system. The rotary antenna system also includes a rotor for attachment to the microwave antenna. The rotor also includes a plurality of electrical conducting brushes, electrically connected to the electronics of the antenna, for contacting the slip ring circuits and for carrying DC power and low frequency signals to the antenna. The rotor is rotatably coupled to the stator so that the rotor rotates relative to the stator and is concentric with the axis of rotation of the microwave antenna. In some embodiments, the microwave antenna includes an r.f. microwave antenna, and the rotor includes a flat plate antenna for mounting the microwave antenna to the rotor on the side of the rotor opposite to the brushes.

In preferred embodiments of the invention, the stator includes a disk having a peripheral edge around its circumference, and the rotor includes an annular ring having an inner edge around a central opening and a peripheral edge around its circumference. The inner edge of the rotor is positioned adjacent to, concentric with, and is rotatably coupled to the peripheral edge of the central disk by means of an assembly of ball bearings placed between the two adjacent edges. The annular ring of the rotor includes a raised portion of a disk surface, and the surface of the stator is disposed adjacent to the disk surface of the rotor.

Thus, the present invention offers the cost savings advantages of requiring fewer rotational bearings than systems offering similar performance, eliminating cable assemblies and separate antenna pedestals, and having lower maintenance and fewer connections. The lower profile and weight of the rotary joint microwave coupler and slip ring allows for smaller, more aesthetically pleasing rotary microwave antenna installation for use with, for instance, vehicle-borne satellite or cellular microwave radio telecommunications. Maintenance of the resulting rotary microwave antenna system is significantly reduced and reliability increased due to the smaller quantity of moving parts and bearings present in the rotary microwave antenna system of this invention.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DESCRIPTION OF THE EMBODIMENTS OF THE INVENTION

Figure 1:
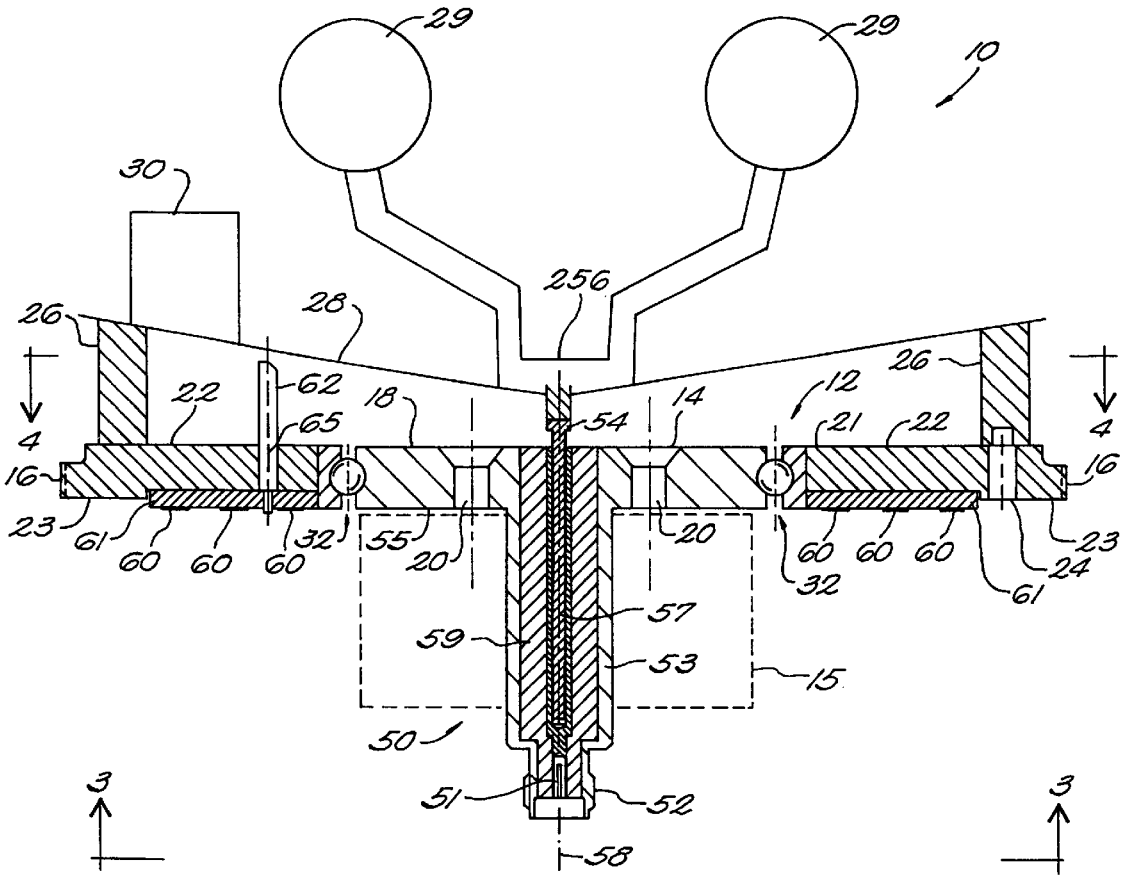
FIG. 1 is a cross-sectional view of a preferred embodiment of the rotary microwave antenna system of this invention featuring an integrated rotary microwave joint and slip ring assembly having a low profile and simple, economic construction.

Referring to FIG. 1, a preferred embodiment of a rotary microwave antenna system 10 of this invention features a low profile integrated rotary microwave joint and slip-ring assembly 12 having a stator 14 rotatably connected to an integrated gear rotor 16 by ball bearing structure 32. Stator 14 includes a substantially flat central disk 18 having several mounting holes 20 for attaching the stator to a mobile platform 15 (e.g., an automobile, train, military vehicle, aircraft, etc.) containing the microwave radio telecommunications system which uses the rotary antenna system 10.

Rotor 16 includes a substantially flat annular ring 22 having opposite surfaces 21 and 23, and mounting holes 24 for attaching microwave antenna support pedestals 26 to rotor 16. Antenna pedestals 26 support a microwave antenna groundplane 28, one or more microwave antennas 29, and microwave electronics assembly 30, which all rotate with the rotor 16 relative to stator 14 and the mobile platform 15.

Figure 2:
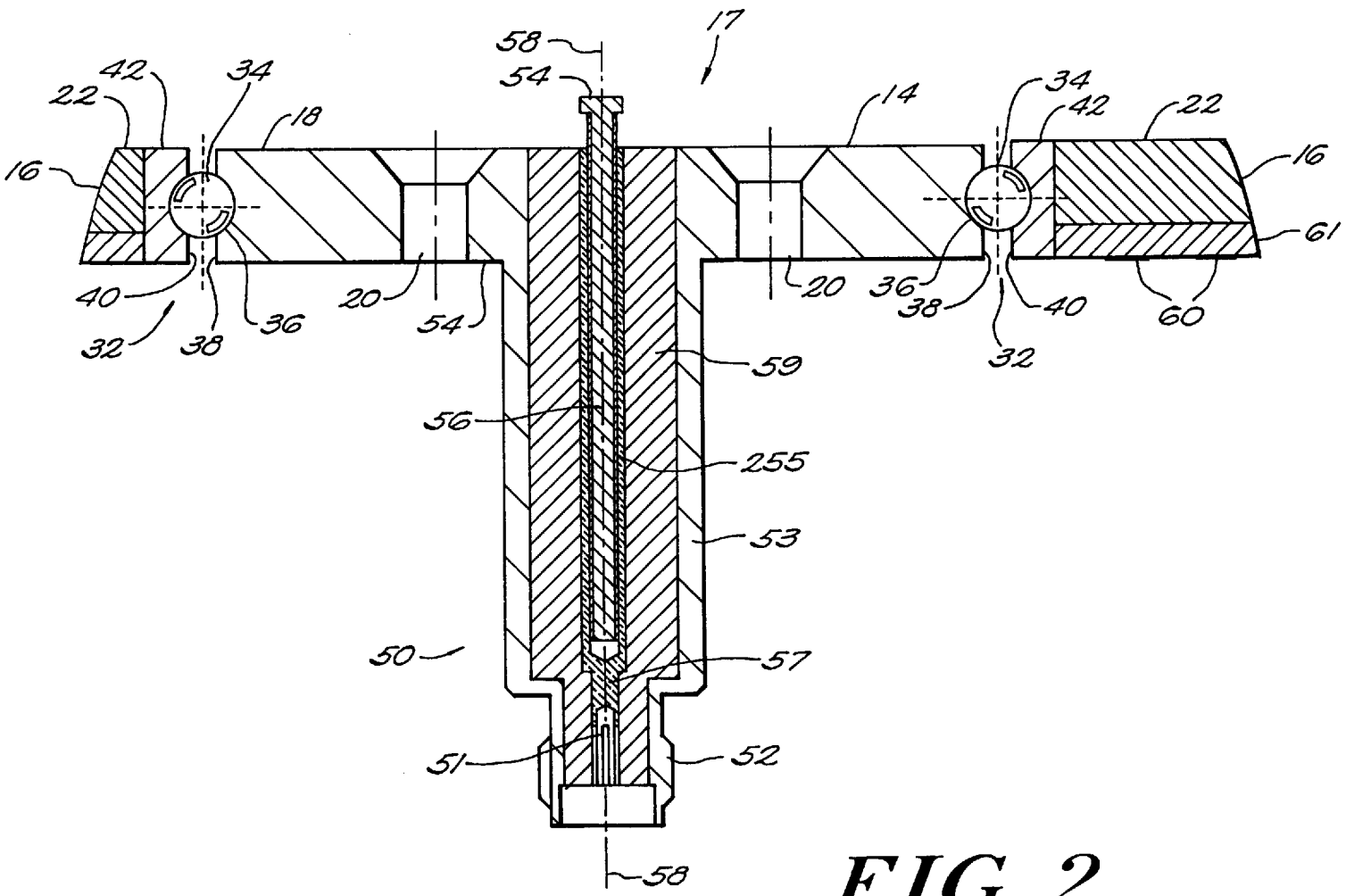
FIG. 2 is an enlarged cross-sectional view of the central portion of the integrated rotary microwave joint and slip ring assembly of FIG. 1, with the microwave antenna elements removed for clarity.

Referring now also to FIG. 2, rotor 16 is rotatably mounted concentrically and coplanar with stator 14, within a central opening 17 of rotor annular ring 22, by means of a bearing structure 32. This concentric/coplanar construction allows the rotary joint and slip ring assembly to have a very low profile, yet offer a strong, stable rotatable base to support a microwave antenna assembly. No separate standalone bearing/race assembly is needed. Rather, the bearing structure 32 is built directly into the rotor and stator structures. In one embodiment of bearing structure 32, a quantity of steel ball bearings 34 ride within a channel 36 cut into the outer peripheral edge 38 of the central disk 18 of stator 14 and the inner edge 40 of rotor 16, which can, for example, be a separate edge structure 42 attached to the rotor 16. In the case where the stator or rotor is manufactured from a metal material, such as aluminum or steel, the ball bearing channel can be cut directly into the material. In the case where the stator or rotor is manufactured from a composite or plastic material, such as polycarbonate, a metal edge, such as aluminum or steel, is added to the stator or rotor and the ball bearing channel is cut into the metal edge. In the exemplary embodiment shown in FIG. 2, stator 14 is manufactured from aluminum and rotor 16 is manufactured from polycarbonate. An aluminum edge 42 is used to form the inner edge 40 of the rotor 16. It will be apparent to those skilled in the art that preconstructed ball bearing races can also be used in place of the bearing structure 32. Such preconstructed ball bearing races would be inserted between the inner edge of the rotor and the outer edge of the stator, with the stator and rotor being appropriately sized to accommodate the bearing races.

Referring again also to FIG. 1, stator 14 includes a single channel rotary joint coaxial transmission line coupler 50 terminated on one end by a standard microwave transmission line connector 52 (e.g., an SMA jack receptacle) for connection to the microwave radio telecommunications system, and on the other end by a terminal post 54 directly connected by solder or weld to a microwave antenna feed element 256, such as power divider feeding antenna elements 29. Rotary joint transmission line coupler 50 is constructed from a cylindrical outer conducting shell 53 attached to and extending perpendicular from surface 55 of the central disk 18, on the side opposite from the antenna elements. Conducting shell 53 is coaxial with the axis 58 about which the rotor 16 and the microwave antenna elements rotate (i.e., the axis of rotation).

Rotary joint transmission line coupler 50 also includes a stationary center conductor 57 passing through shell 53 along axis of rotation 58. Stationary center conductor 57 is electrically connected on one end to the center pin 51 of microwave transmission line connector 52 to connect to the center conductor of the coaxial transmission line connected to connector 52. Metal construction of the central disk 18 and outer shell 53 of stator 14 provide an excellent r.f. shield for the stationary center conductor 57. A dielectric sleeve 59 insulates the stationary center conductor 57 from the metallic shell 53. Stationary center conductor 57 includes a central cylindrical void 255 (see FIG. 2) traversing most of the length of the conductor for accepting an insulated rotary center conductor 56. Rotary center conductor 56 terminates on one end in terminal post 54 which is electrically and mechanically connected to the microwave antenna elements, as discussed above, and rotates with the antenna elements 29 relative to stationary center conductor 57. In operation, the stationary center conductor 57 is capacitively coupled to rotary center conductor 56 over their overlapping lengths to effectively couple microwave energy between the coaxial transmission line attached to connector 58 and microwave antenna elements 29 through terminal post 54.

Figure 3:
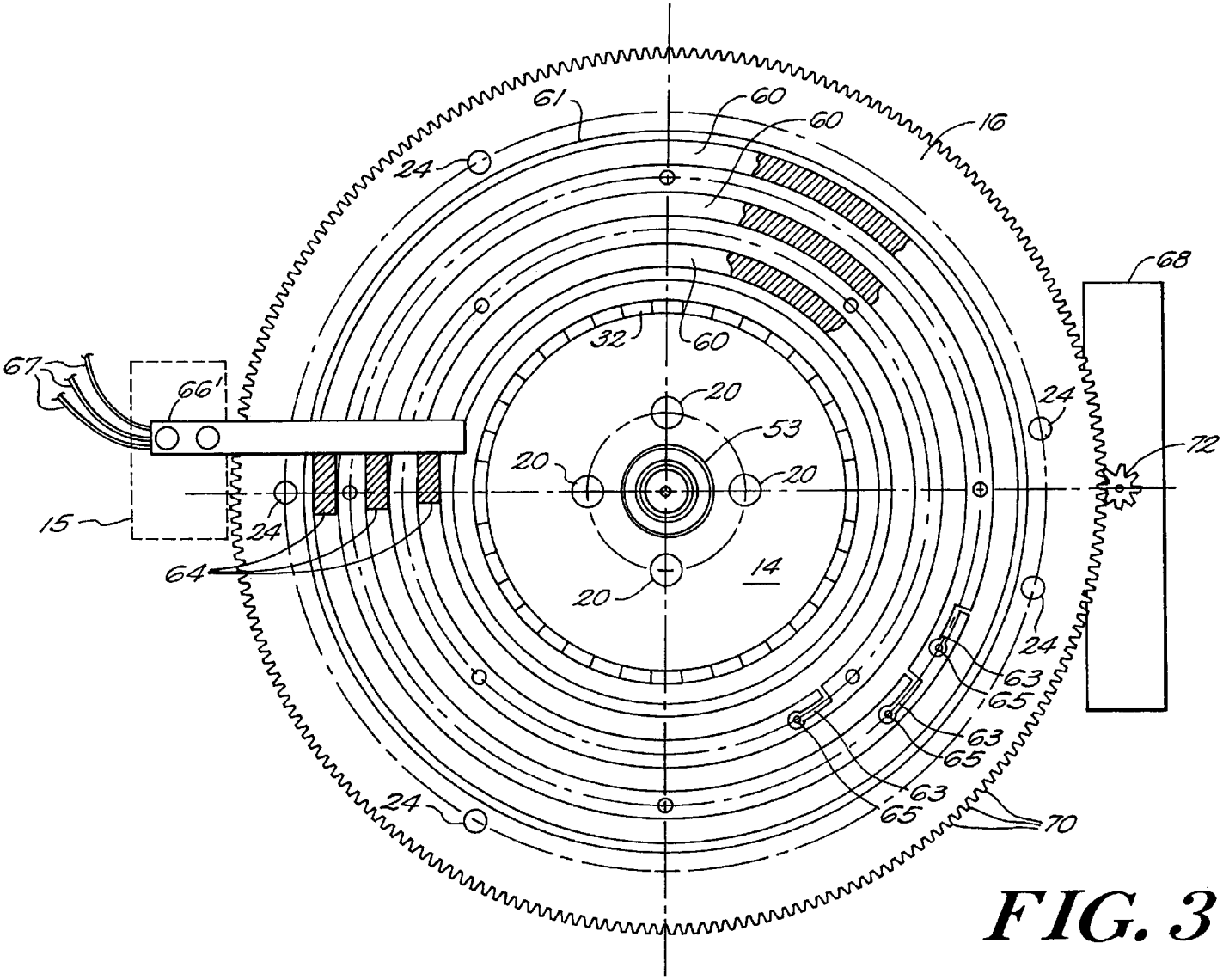
FIG. 3 is a bottom plan view of the rotary microwave antenna system of this invention taken along line 3—3 of FIG. 1 showing details of the slip ring circuits and the gear drive mechanism.

Referring now to FIG. 3, rotor 16 can be constructed from plastic or composite materials to save weight and cost, to provide good thermal properties as a main housing to protect the bearings from damage, and to provide a substrate on which to construct a slip ring to couple DC power and low frequency signals to the microwave antenna elements from the microwave radio telecommunications system mounted to the mobile platform (e.g., the microwave transmitter and receiver). Rotor 16 includes one or more concentric slip ring circuits 60, or channels, fabricated on an annular ring printed circuit board substrate 61. Printed circuit substrate 61 is mounted to rotor annular ring surface 23 (see FIG. 3) on the side opposite from the antenna elements with, for example, epoxy or another suitable adhesive. Each slip ring circuit 60 is terminated in a solder tab circuit 63 which is offset from each of the circuit channels 60, and has a hole 65 which penetrates printed circuit board substrate 61 and rotor 16 for accepting a soldered wire connection. In one embodiment, slip ring circuits 60 are 0.2 inches in width, are manufactured using printed circuit board fabrication techniques from 1 oz. copper, and are plated with hard gold, including through hole plating of hole 65.

Figure 4:
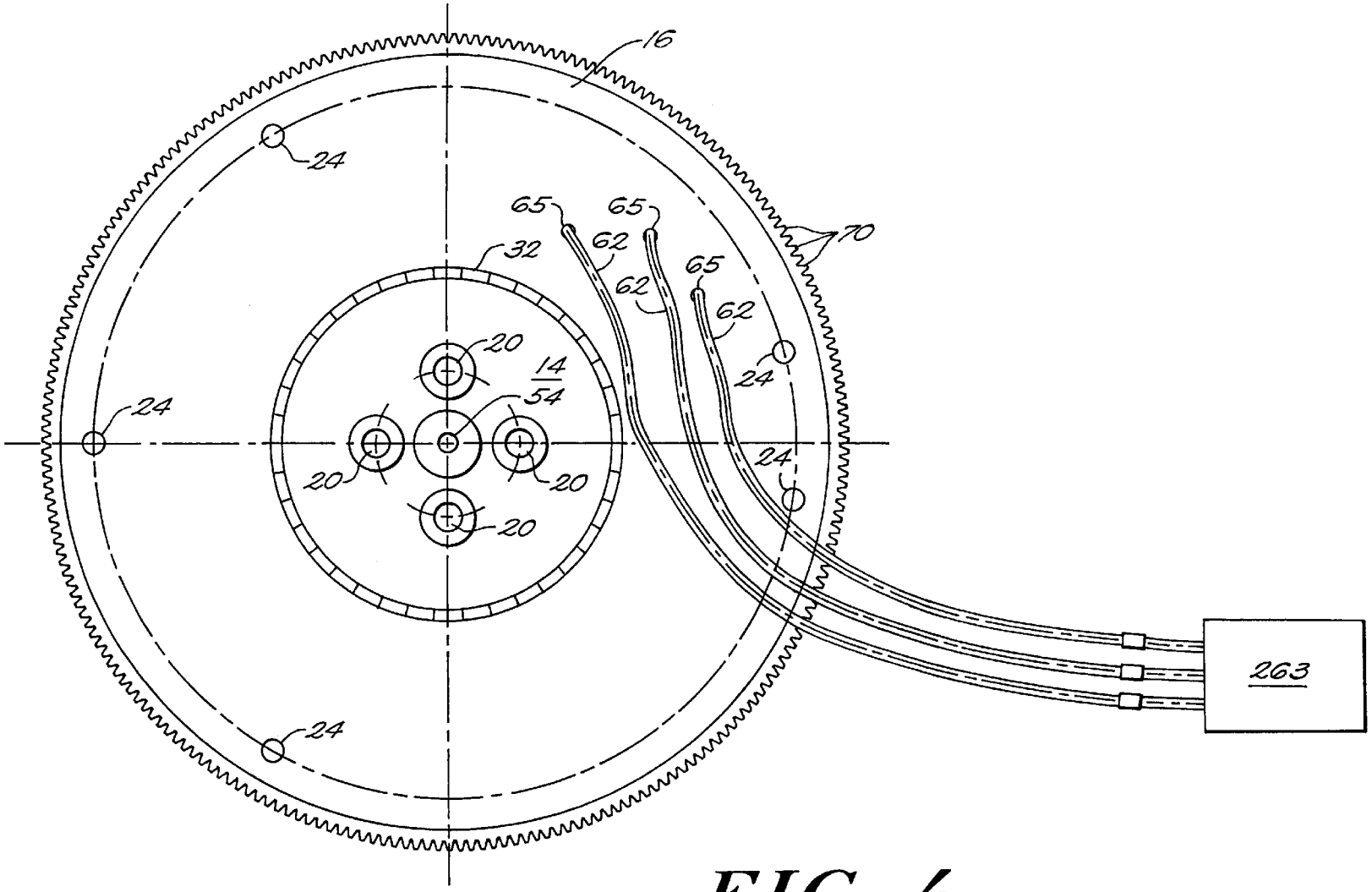
FIG. 4 is a top plan view of the rotary microwave joint and slip ring assembly of the integrated rotary microwave antenna system of this invention taken along line 4—4 of FIG. 1, with the microwave antenna elements removed for clarity.

Referring now also to FIG. 4, each slip ring circuit 60 (see FIG. 3) is connected by a wire 62 to a connector harness 263 for connection to the antenna circuitry. Each wire 62 passes through on hole 65 in rotor 16 and substrate 61 and is soldered to a corresponding solder tab trace 63 leading from the appropriate slip ring circuit. As seen in FIG. 3, slip ring circuits 60 are each contacted by a resilient electrically conductive brush 64 (e.g., gold wire), of a stationary brush assembly 66 attached to the mobile platform 15. Each brush 64 is electrically connected to a DC power or low frequency signal circuit in the microwave radio telecommunications system attached to the mobile platform 15 by wires 67.

The outer peripheral edge of rotor 16 can be fashioned to mechanically couple to a drive motor 68 (see FIG. 3), or other type of drive mechanism, for rotating the rotor 16 and slip ring relative to the stator 14. In one embodiment, gear teeth 70 are cut into the outer peripheral edge of rotor 16 so that they mesh with a drive gear 72 (see FIG. 3) of drive motor 68 (see FIG. 3) attached to platform 15. In another embodiment, the outer peripheral edge can be coated with a frictional surface to contact a drive wheel to rotate rotor 16.

In preferred embodiments of this invention, the rotary microwave joint and slip ring of this invention is capable of coupling microwave energy from a microwave transmission line to a microwave antenna element over a frequency range of about 1 to 2 GHz. In one embodiment, the rotary microwave joint and slip ring is used with a mobile satellite microwave radio telecommunications system operating at microwave frequencies between 1.4 and 1.7 GHz. The rotary microwave joint is capable of matching a microwave transmission line to a microwave antenna element with a VSWR of 1.20:1 or less. The rotary joint is capable of handling in excess of 20 watts of microwave transmit power, features low insertion loss (e.g., less than 0.1 dB) and low noise (less than 0.1 dB).

Mechanically, in embodiments of this invention, the rotary microwave antenna system is ideal for high reliability, low maintenance, low rotational speed applications of about 1 rpm for several million rotation cycles, such as vehicle mounted mobile cellular or satellite radio telecommunications systems. The construction of the rotary microwave joint and slip ring assembly as described above results in a low profile, light weight and highly reliable rotary microwave antenna system. Low profile is mainly achieved through the coplanar mating of the rotor 16 and stator 14, which also have substantially similar thickness. Such construction allows the use of a single, integrated, simple bearing structure 32 between the rotor and stator, which also holds the assembly together. The integrated antenna pedestal and direct connection of the rotary joint center conductor to the microwave antenna element provide for a simple and compact design. The use of light weight materials such as plastic and aluminum, along with the single bearing structure and the reduced parts count, result in light weight and low rotational mass. The low rotational mass of the antenna system allows the use of an inexpensive drive motor 68 to rotate the antenna elements. The low rotational mass of the antenna system also enhances the reliability of the system due to lower rotational stresses and resulting lower wear on the bearings and other components. The result is a rotary joint slip ring assembly costing less than one-tenth the cost and less than one-quarter the size of a system built from standard components, and an antenna system having substantially reduced height and overall size and weight. Applications of the principles disclosed herein have resulted in a rotary joint and slip ring assembly for an microwave antenna system having a maximum rotational torque of 4.0 in.-oz., weighing less than 1.0 lbs., having a mean time between failure of 75,000 hours, having a survival shock of 30 G, and having a vibrational survival of 1.7 G. The system operates over a wide range of environmental conditions with the proper grease in the bearings and chemical conversion finish on the aluminum parts.

Figure 5:
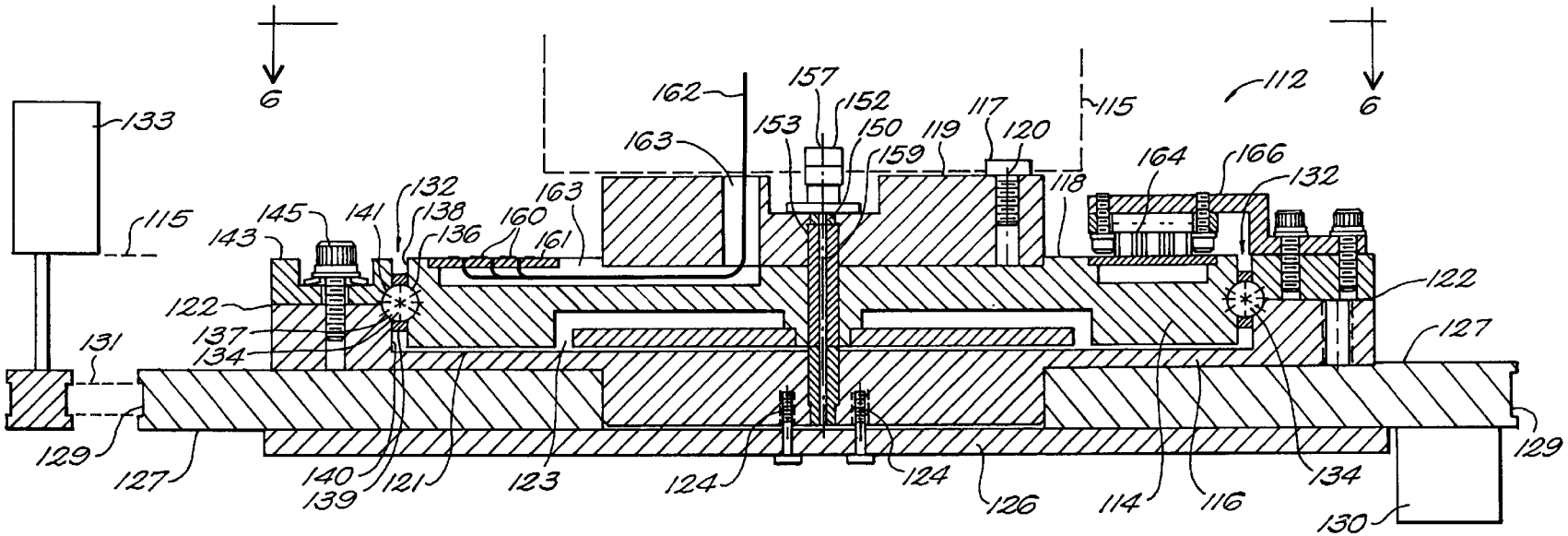
FIG. 5 is a cross-sectional view of another preferred embodiment of an integrated rotary microwave antenna system for use with the rotary microwave antenna system of this invention.
Figure 6:
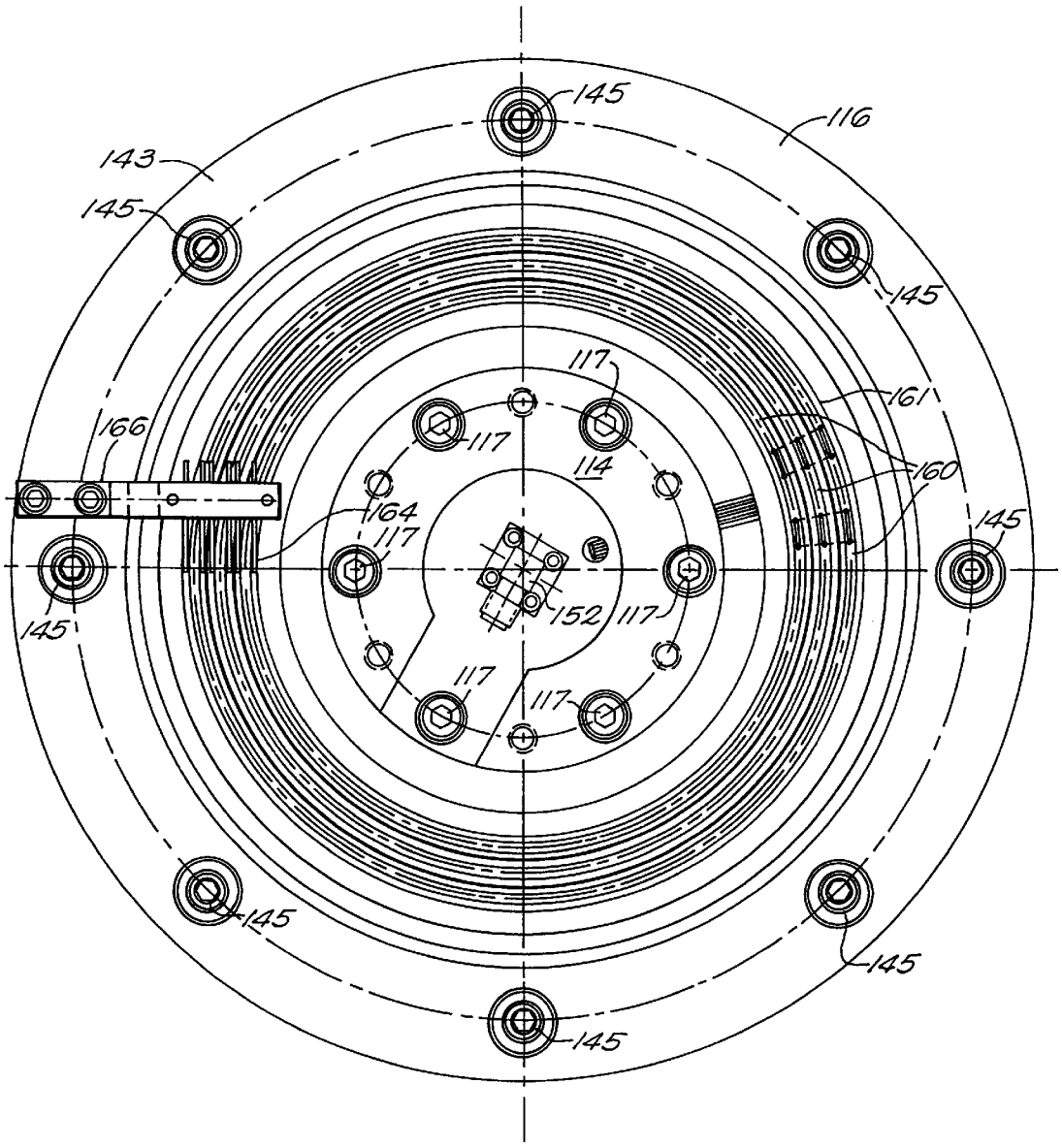
FIG. 6 is a top plan view of the integrated rotary microwave antenna system of this invention taken along line 6—6 of FIG. 5, with the microwave antenna elements removed for clarity.

Referring to FIGS. 5 and 6, another embodiment of a microwave antenna system of this invention has a low profile, integrated, rotary microwave joint and slip-ring assembly 112 featuring a stator 114 rotatably connected to a rotor 116. Stator 114 includes a substantially flat central disk 118 having a raised central portion 119 with several mounting holes 120 for attaching the stator to a mobile platform 115 (e.g., an automobile, military vehicle, aircraft, etc.) using standard mounting hardware 117. Rotor 116 is fashioned from a substantially flat disk 121 and has a raised annular ring 122 around the periphery of the disk, forming a recess 123 adjacent to the disk 121 surface. Rotor 116 has mounting holes 124 for attaching an antenna 126 to rotor 116. In one embodiment, antenna 126 is a flat plate microwave antenna and includes a drive wheel portion 127 having a peripheral edge 129 adapted to accept a drive belt 131 driven by a motor 133 attached to mobile platform 115. Antenna 126 also supports a microwave electronics assembly 130 which rotates along with the rotor 116 and antenna 126 relative to stator 114 and the mobile platform 115.

Stator 114 is rotatably mounted within the recess 123 adjacent to the flat disk surface 121 of rotor 116, concentric with annular ring 122, by means of a bearing structure 132. In one embodiment of bearing structure 132, steel ball bearings 134 ride within a channel 136 cut into the outer peripheral edge 138 of the central disk 118, and a channel 137 cut into the inner edge 140 of annular ring 122 and the inner edge 141 of a retaining ring 143 fastened to the annular ring 122. The ball bearings are separated from one another in channel 136 by means of TEFLON™ ball separators 139 which are placed adjacent to each ball. Retaining ring 143 is fastened to the annular ring 122 with several machine bolts 145 and act to hold the bearings in place, and the stator 114 and rotor 116 together. In the exemplary embodiment shown in FIGS. 5 and 6, stator 114 and rotor 116 are manufactured from steel that they can support a much heavier antenna assembly, thus eliminating the need for a pedestal.

Figure 7:
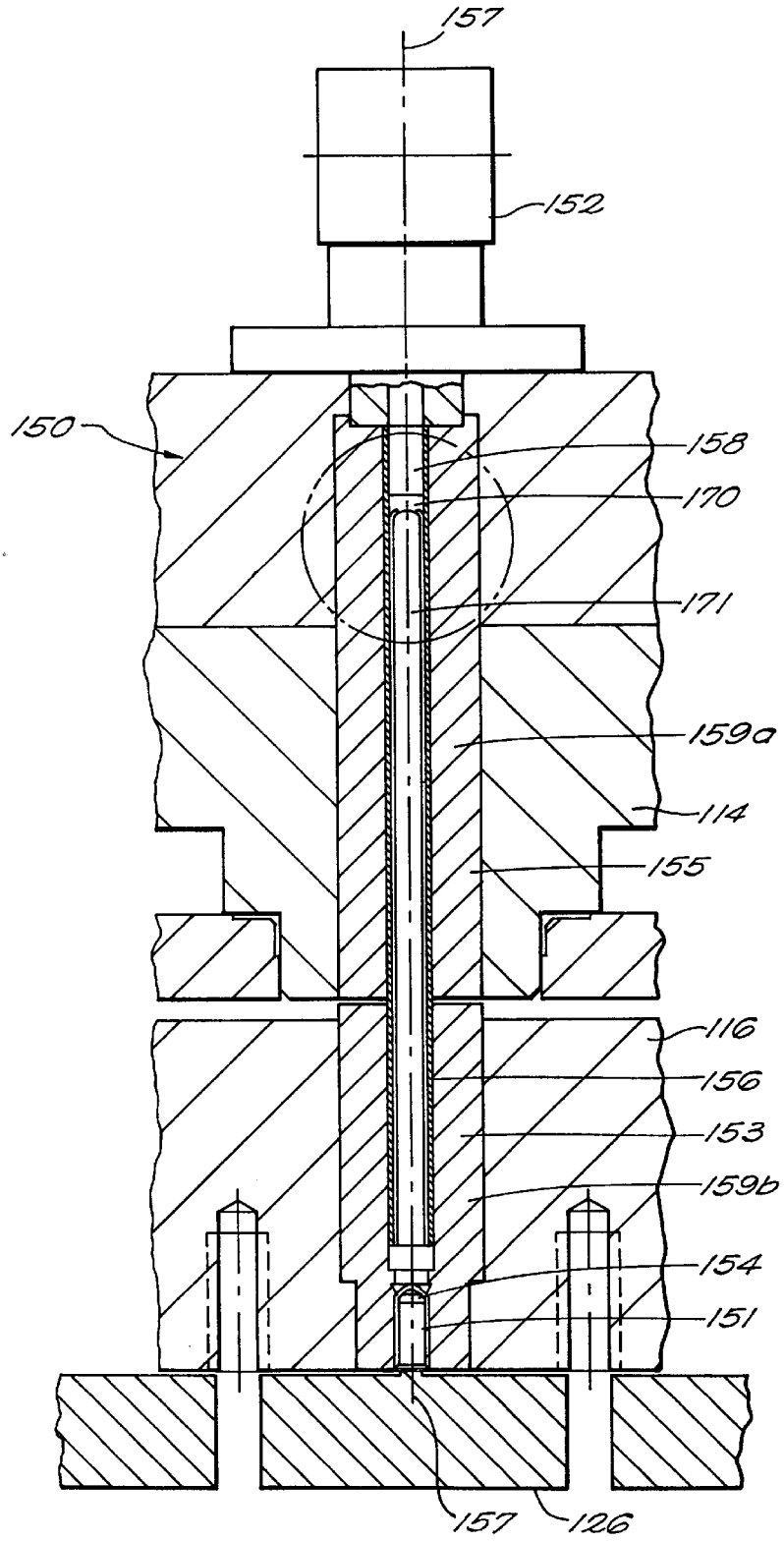
FIG. 7 is an enlarged cross-sectional view of the rotary microwave joint portion of the rotary microwave antenna system of FIG. 5.

Referring now to FIG. 7, stator 114 and rotor 116 include a single channel rotary joint coaxial transmission line coupler 150 terminated on one end by a standard microwave transmission line connector 152 (e.g., an SMA jack receptacle) for connection to the microwave radio telecommunications system, and on the other end by an electrical connector 154 for direct connection to microwave antenna 126 (see FIG. 5) by, for example, pin 151 inserted into connector 154. Rotary joint transmission line coupler 150 is constructed from a cylindrical passage 155 through the stator 114, aligned with a cylindrical passage 153 through the rotor 116 coaxial with the axis of rotation 157 about which the rotor 116 and microwave antenna system rotate (i.e., the axis of rotation).

Rotary joint transmission line coupler 150 includes a stationary center conductor 156 passing through cylindrical passages 153 and 155 along axis of rotation 157. Stationary center conductor 156 is electrically connected on one end to center pin 158 of microwave transmission line connector 152 to connect to the center conductor of the coaxial transmission line connected to connector 152. Metal construction of the stator 114 and rotor 116 provide an excellent r.f. shield for stationary center conductor 156. Dielectric sleeves 159*a* and 159*b* insulate the stationary conductor 156 from the stator 114 and rotor 116, respectively. Stationary center conductor 156 includes a central cylindrical void 170 traversing most of the length of the center conductor for accepting an insulated rotary center conductor 171. Rotary center conductor 171 terminates on one end at pin 151 for connection to the microwave antenna 126, and rotates with the antenna and rotor relative to stationary center conductor 156. As with the rotary microwave joint described above, the stationary center conductor 156 is capacitively coupled to the rotary center conductor 171 over their overlapping lengths to effectively couple microwave energy between the coaxial transmission line attached to connector 152 and microwave antenna 126.

Referring again to FIGS. 5 and 6, stator 114 has one or more slip ring circuits 160, or channels, laid concentrically upon an annular printed circuit board substrate 161, which is mounted to stator 114 so as to be substantially flush with the stator surface. The slip ring circuits on the annular circuit board substrate 116 can be substantially the same as those described earlier. Each slip ring circuit 160 is connected by a wire 162 which accesses the slip ring circuit from under the substrate and passes through channels 163 on the stator as seen in FIG. 5. Wires 162 are connected to DC power and low frequency signals in the mobile platform system. Slip ring circuits 160 are each contacted by a brush 164 (e.g., gold wire), of a brush assembly 166 attached to the rotor 116, to electrically connect DC power and low frequency signals to the microwave antenna subsystem. Thus, in contrast to the embodiment shown in FIGS. 1–4, which has a rotating slip ring structure, the embodiment of FIG. 5 has a stationary slip ring structure attached to the stator 114, and brushes 164 that rotate relative to the stationary slip ring circuits 160.

Equivalents

While this invention has been particularly shown and described with references to preferred embodiments thereof, it will be understood by those skilled in the art that various changes in form and details may be made therein without departing from the spirit and scope of the invention as defined by the appended claims. For example, although the invention is described with respect to satellite and cellular radio telephone communications, the technology of this invention can be applied to a wide variety of applications requiring directional radio antennas. The invention can also be applied to other applications such as audio listening and laser and optical devices.

We claim:

1. A rotary microwave antenna system for transmitting and receiving microwave signals, comprising:

a stator for attachment to a platform, including a rotating joint coaxial microwave coupler for electrically coupling a microwave signal between a microwave transmission line and a microwave antenna element of a microwave antenna, the microwave antenna also having antenna electronics mounted thereto, the microwave antenna element being rotatable about an axis relative to the stator, a rotor for attachment to the microwave antenna, including a slip ring circuit for coupling power and low frequency electrical signals to the antenna electronics, the slip ring including an annular disk positioned around the stator and having a plurality of concentric electrical conducting channels electrically connected to the antenna electronics, the rotor being rotatably coupled to the stator so that the rotor rotates relative to the stator and concentric with the axis of rotation of the microwave antenna element, and a plurality of electrical conducting brushes mounted stationary relative to the platform and adjacent to the concentric electrical conducting channels of the slip ring, each brush in movable electrical contact with the concentric electrical conducting channel adjacent thereto, wherein the electrical conducting brushes are electrically connected to power and low frequency electrical signal sources for supplying said power and said low frequency electrical signals to the antenna electronics through the electrical conducting brushes and their adjacent concentric electrical conducting channel.

2. The system of claim 1, wherein the rotary joint coaxial microwave coupler comprises a center conductor rotatable about the axis of rotation of the microwave antenna element relative to the stator and mechanically and electrically connected to the microwave antenna element, and a transmission line connector mounted to the stator, wherein the center conductor is electrically coupled to the transmission line connector for transferring microwave energy between the transmission line and the microwave antenna element.

3. The system of claim 2, wherein the stator comprises a central disk having a peripheral edge around a circumference thereof, and the rotor comprises an annular ring having an inner edge around a central opening thereof and a peripheral edge around a circumference thereof, and the inner edge of the annular ring is adjacent to, concentric with, and rotatably coupled to the peripheral edge of the central disk by means of an assembly of ball bearings placed between the inner edge of the annular ring and the peripheral edge of the central disk.

4. The system of claim 3, wherein the peripheral edge of the annular ring comprises a surface for coupling to a drive motor for rotating the rotor relative to the stator.

5. The system of claim 4 wherein the surface of the peripheral edge of the annular ring comprises gear teeth for coupling to a motor driven drive gear.

6. The system of claim 4 wherein the surface of the peripheral edge of the annular ring comprises a friction surface for fictionally coupling to a drive motor.

7. The system of claim 3, wherein the rotor comprises an antenna pedestal for mounting the microwave antenna to the rotor.

8. The system of claim 3, wherein the stator central disk and the rotor annular ring are substantially the same thickness.

9. The system of claim 3, wherein the rotor is rotatably coupled to the stator by ball bearings.

10. A rotary microwave antenna system for transmitting and receiving microwave signals, comprising:

a stator for attachment to a platform, including a rotary joint coaxial microwave coupler for electrically coupling a microwave signal between a microwave transmission line and a microwave antenna element of a microwave antenna, the microwave antenna also having antenna electronics mounted thereto, the microwave antenna element being rotatable about an axis relative to the stator, and a slip ring circuit for coupling power and low frequency electrical signals to the antenna electronics, the slip ring having an annular disk positioned concentric with the microwave antenna element axis of rotation and having a plurality of concentric electrical conducting channels mounted upon a first surface of the annular disk, the concentric electrical conducting channels being electrically connected to power and low frequency electrical signal sources for supplying said power and said low frequency electrical signals to the antenna electronics, and a rotor for attachment to the microwave antenna, including a plurality of electrical conducting brushes electrically connected to the antenna electronics and mounted stationary relative to the rotor and adjacent to the concentric electrical conducting channels of the slip ring, each brush in movable electrical contact with the concentric electrical conducting channel adjacent thereto, the rotor being rotatably coupled to the stator so that the rotor rotates relative to the stator and concentric with the axis of rotation of the microwave antenna, wherein said power and said low frequency electrical signals are coupled to the antenna electronics through the concentric electrical conducting channels and their adjacent electrical conducting brush.

11. The system of claim 10, wherein the rotary joint coaxial microwave coupler comprises a center conductor rotatable about the axis of rotation of the microwave antenna relative to the platform and mechanically and electrically connected to the microwave antenna element, and a transmission line connector mounted to the stator, wherein the center conductor is electrically coupled to the transmission line connector for transferring microwave energy between the transmission line and the microwave antenna element.

12. The system of claim 11, wherein the stator comprises a central disk having a peripheral edge around a circumference thereof, and the rotor comprises an annular ring having an inner edge around a central opening thereof and a peripheral edge around a circumference thereof, and the inner edge of the annular ring is adjacent to, concentric with, and rotatably coupled to the peripheral edge of the central disk by means of an assembly of ball bearings placed between the inner edge of the annular ring and the peripheral edge of the central disk.

13. The system of claim 12, wherein the annular ring of the rotor comprises a raised portion of a disk surface, and the central disk of the stator is disposed adjacent to the disk surface of the annular ring.

14. The system of claim 12, wherein the microwave antenna comprises flat plate microwave antenna, and the rotor comprises a platform for mounting the microwave antenna to the rotor.

15. The system of claim 12, wherein the central disk of the stator and the rotor annular ring are substantially the same thickness.

16. The system of claim 12, wherein the rotor is rotatably coupled to the stator by ball bearings.

* * * * *